US009997117B2

(12) United States Patent
Cao

(10) Patent No.: US 9,997,117 B2
(45) Date of Patent: Jun. 12, 2018

(54) COMMON CIRCUIT FOR GOA TEST AND ELIMINATING POWER-OFF RESIDUAL IMAGES

(71) Applicant: Wuhan China Star Optoelectronics Technology Co., Ltd., Wuhan (CN)

(72) Inventor: Shangcao Cao, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 379 days.

(21) Appl. No.: 15/008,427

(22) Filed: Jan. 27, 2016

(65) Prior Publication Data

US 2017/0092209 A1 Mar. 30, 2017

(30) Foreign Application Priority Data

Sep. 25, 2015 (CN) ..... 2015 1 0626658

(51) Int. Cl.

*G09G 3/36* (2006.01)
*G09G 3/18* (2006.01)
*G09G 3/00* (2006.01)

(52) U.S. Cl.

CPC ..... *G09G 3/3611* (2013.01); *G09G 3/006* (2013.01); *G09G 3/18* (2013.01); *G09G 3/3677* (2013.01); *G09G 2300/0408* (2013.01)

(58) Field of Classification Search

CPC .. G09G 2300/0408; G09G 3/006; G09G 3/18; G09G 3/3611; G09G 3/3677

See application file for complete search history.

(56) References Cited

U.S. PATENT DOCUMENTS

2008/0100331 A1* 5/2008 Qi ..... G09G 3/3648 324/750.3
2012/0056186 A1* 3/2012 Shirouzu ..... G02F 1/136204 257/59
2012/0099043 A1* 4/2012 Sun ..... H01L 29/41733 349/43

* cited by examiner

*Primary Examiner* — Viet Pham
(74) *Attorney, Agent, or Firm* — Leong C. Lei

(57) ABSTRACT

The invention discloses a common circuit for GOA test and eliminating power-off residual images, including a first test end (3), a test signal line (AT1) connected to the first test end (3), a second test end (5), a feedback signal line (AT2) connected to the second test end (5), and the same number of test TFTs (T0) as cascade GOA unit circuits. By connecting the gate of each test TFT (T0) to test signal line (AT1), the source to feedback signal line (AT2) and the drain to the output end of corresponding GOA unit circuit and gate scan line, the invention can test the output signal of any stage GOA unit circuit to determine the location of a malfunctioning GOA unit circuit, and releasing the residual charges of the liquid crystal capacitor and storage capacitor at the display area of LCD panel when powering off to eliminate residual images.

9 Claims, 5 Drawing Sheets

COMMON CIRCUIT FOR GOA TEST AND ELIMINATING POWER-OFF RESIDUAL IMAGES

BACKGROUND OF THE INVENTION

1. Field of the Invention

The present invention relates to the field of liquid crystal display (LCD), and in particular to a common circuit for gate driver on array (GOA) test and eliminating power-off residual images.

2. The Related Arts

As the liquid crystal display (LCD) shows the advantages of being thin, low power-consumption, and no radiation, the LCD is widely used in various devices, such as, liquid crystal TV, mobile phones, PDA, digital camera, PC monitors or notebook PC screens as well as tablet PCs.

The available LCDs are mostly backlight type, which includes an LCD panel and a backlight module. The operation theory behind the LCD panel is to inject liquid crystal molecules between the thin film transistor (TFT) array substrate and the color filter (CF), and then apply a driving voltage to control the rotation direction of the liquid crystal molecules to refract the light from the backlight module to generate the image.

The display area of LCD panel includes a plurality of pixels arranged in matrix, with each column of pixels electrically connected to a scan line and each row of pixel electrically connected to a data line. As shown in FIG. 1, m and n are both positive integers. The pixel driver circuit of the pixel at the n-th column and m-th row includes a thin film transistor T. The gate of T is connected to the horizontal gate scan line Gate(n) of the n-th column. The drain of T is connected to the vertical data line Data(m) of the m-row. The source is connected to the corresponding pixel electrode. The equivalence of a liquid crystal capacitor Clc and a storage capacitor Cst connected in parallel exists between the source of T and the common voltage line Com. When the LCD panel functions normally, a sufficient positive voltage applied to the scan line will make all the Ts on the gate scan line conductive to load data signal from the data line into the pixel electrode to control the transmittance of different liquid crystal molecules to achieve the color control effect to display an image. The liquid crystal capacitor Clc and the storage capacitor Cst of the LCD panel will accumulate electric charges during normal operation. When powered off, the accumulated electric charges do not receive proper release, resulting in DC residual in the liquid crystal molecules to cause residual images on the LCD panel, often referred to as power-off residual images.

The driving of the gate scan line of LCD panel is first accomplished by the external integrated circuit (IC). The external IC is able to control the stepwise charge and discharge of the gate scan line. The gate driver on array (GOA) technology uses the array manufacturing process of LCD panel to form driver circuit of the gate scan line in the surrounding area of the display area of the substrate to replace the external IC to perform the gate scan line driving. GOA technology can reduce the bonding process for external IC to improve yield rate and reduce manufacturing cost. Moreover, the GOA technology also makes LCD panel easier for narrow border or borderless display product.

Because the TFT electrical stability and uniformity affects the GOA circuit yield rate, GOA circuit must be tested. A common test is to test the output signal of the final stage GOA unit to determine whether the GOA circuit is normal. However, this type of test can only test the output signal of the final GOA unit, and is unable to determine specifically which stage of GOA unit is faulty, which limits the analysis and improvement on the GOA circuit.

SUMMARY OF THE INVENTION

The object of the present invention is to provide a common circuit for GOA test and eliminating power-off residual images, able to test the output signals of any stage of GOA circuit to determine the specific location of the faulty GOA circuit, as well as to discharge the residual electric charge of the liquid crystal capacitor and the storage capacitor when powering off to eliminate the power-off residual images.

To achieve the above object, the present invention provides a common circuit for GOA test and eliminating power-off residual images, which comprises: a plurality of cascade GOA unit circuits, disposed at a side of a display area of an LCD panel, for a positive integer n, an output end of n-th stage GOA unit circuit connected to a corresponding n-th gate scan line of the LCD panel; a first test end, disposed at a side of the display area of the LCD panel; a second test end, disposed at a side of the display area of the LCD panel; a test signal line, disposed at a side of the display area of the LCD panel and electrically connected to the first test end; a feedback signal line, disposed at a side of the display area of the LCD panel and electrically connected to the second test end; and the same number of test TFTs as the plurality of cascade GOA unit circuits, disposed at a side of the display area of the LCD panel; wherein each test TFT having a gate electrically connected to the test signal line, a source electrically connected to the feedback signal line, and a drain electrically connected to the output end of a corresponding GOA unit circuit and a corresponding gate scan line.

According to a preferred embodiment of the present invention, the common circuit for GOA test and eliminating power-off residual images further comprises: a plurality of cascade GOA unit circuits, disposed at the other side of a display area of an LCD panel, for a positive integer n' an output end of n'-th stage GOA unit circuit connected to a corresponding n'-th gate scan line of the LCD panel; a first test end, disposed at the other side of the display area of the LCD panel; a second test end, disposed at the other side of the display area of the LCD panel; a test signal line, disposed at the other side of the display area of the LCD panel and electrically connected to the first test end; a feedback signal line, disposed at the other side of the display area of the LCD panel and electrically connected to the second test end; and the same number of test TFTs as the plurality of cascade GOA unit circuits, disposed at the other side of the display area of the LCD panel; wherein each test TFT having a gate electrically connected to the test signal line, a source electrically connected to the feedback signal line, and a drain electrically connected to the output end of a corresponding GOA unit circuit and a corresponding gate scan line.

According to a preferred embodiment of the present invention, when the common circuit for GOA test and eliminating power-off residual images tests the n-th stage GOA unit circuit, the first test end provides a high-level test pulse signal to the test signal line, the second test end receives an output signal of the n-th stage GOA unit circuit fed back by the test TFT connected to the output end of the corresponding n-th stage GOA unit circuit and the n-th gate scan line transmitted from the feedback signal line to determine whether the n-th stage GOA unit circuit functions normally.

According to a preferred embodiment of the present invention, when the common circuit for GOA test and eliminating power-off residual images tests the n-th stage GOA unit circuit, the first test end provides the high-level test pulse signal to the test signal line based on the delay of the output signal of the n-th stage GOA unit circuit with respect to the a scan starting signal.

According to a preferred embodiment of the present invention, when the common circuit for GOA test and eliminating power-off residual images tests the n-th stage GOA unit circuit, the high-level test pulse signal has a high-level duration longer than the high-level duration of an output signal from a normal n-th stage GOA unit circuit, and the high-level test pulse signal rises before the output signal from the normal n-th stage GOA unit circuit rises and falls after the output signal from the normal n-th stage GOA unit circuit falls.

According to a preferred embodiment of the present invention, when the output signal of the n-th stage GOA unit circuit received by the second test end fed back by the test TFT connected to the output end of the corresponding n-th stage GOA unit circuit and the n-th gate scan line transmitted from the feedback signal line is a high-level pulse signal, the n-th stage GOA unit circuit is determined to be functioning normally; when the output signal of the n-th stage GOA unit circuit received by the second test end fed back by the test TFT connected to the output end of the corresponding n-th stage GOA unit circuit and the n-th gate scan line transmitted from the feedback signal line is a low-level constant-voltage signal, the n-th stage GOA unit circuit is determined to be functioning abnormally.

At the power-off instant, when the first test end provides a high-level signal to the test signal line, and the second test end provides a high-level signal to the feed signal line, all the test TFTs become conductive and the output signals of all the GOA unit circuits rise to the high level.

According to a preferred embodiment of the present invention, the common circuit for GOA test and eliminating power-off residual images is applied to testing single-sided single-driver GOA circuits.

According to a preferred embodiment of the present invention, the common circuit for GOA test and eliminating power-off residual images is applied to testing double-sided double-driver GOA circuits, and double-sided single-driver GOA circuits.

Compared to the known techniques, the present invention provides the following advantages: the present invention provides a common circuit for GOA test and eliminating power-off residual images, having a first test end, a test signal line electrically connected to the first test end, a second test end, a feedback signal line electrically connected to the second test end, and a plurality of test TFTs having the same number as the number of cascade GOA unit circuits. By connecting the gate of each test TFT to the test signal line, the source to the feedback signal line and the drain to the output end of corresponding GOA unit circuit and corresponding gate scan line, the present invention is able to test the output signal of any stage GOA unit circuit to determine the specific location of a malfunctioning GOA unit circuit, as well as releasing the residual charges of the liquid crystal capacitor and the storage capacitor at the display area of the LCD panel when powering off to eliminate the residual images.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 2:
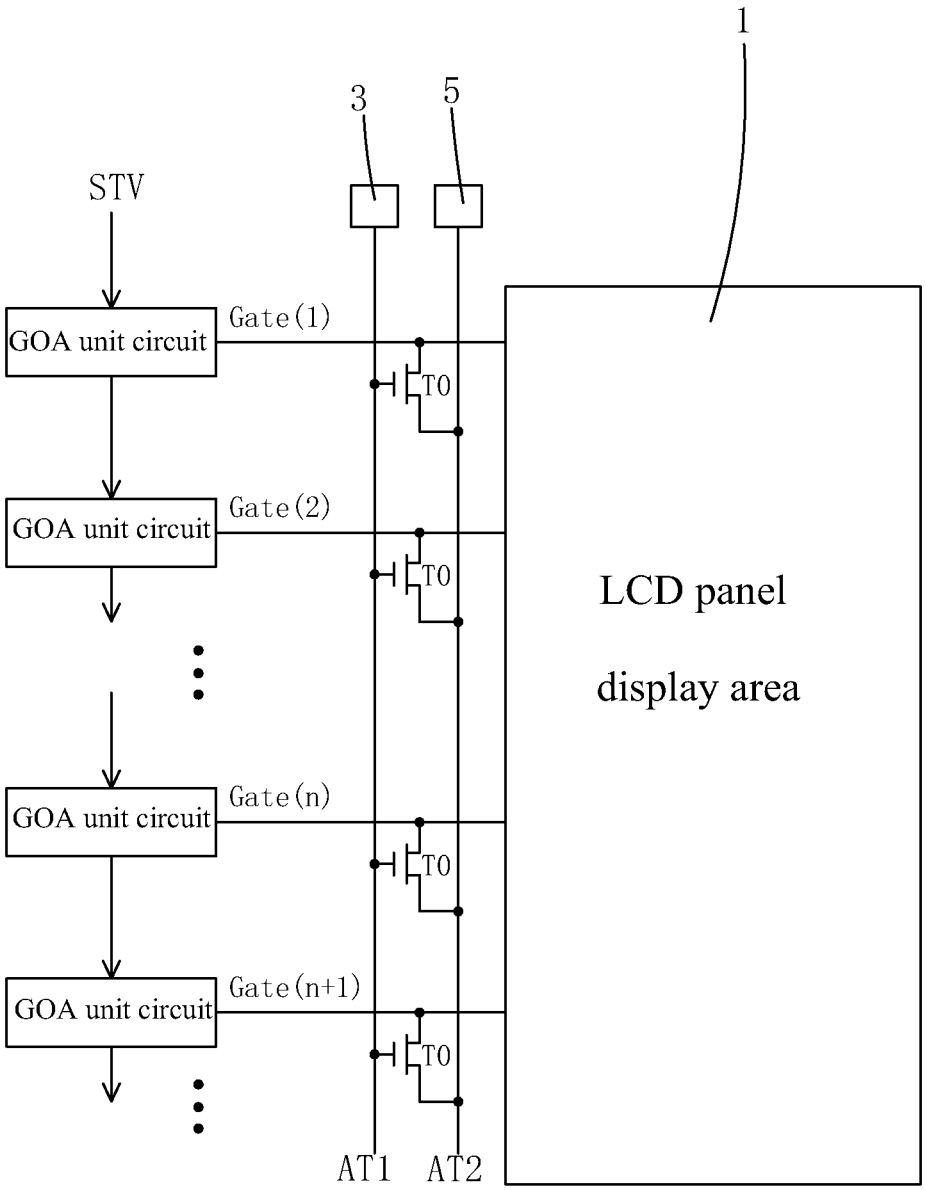
FIG. 2 is a schematic view showing the first embodiment of the common circuit for GOA test and eliminating power-off residual image provided by an embodiment of the present invention.

The present invention provides a common circuit for GOA test and eliminating power-off residual images. FIG. 2 is a schematic view showing the first embodiment of the common circuit for GOA test and eliminating power-off residual image provided by an embodiment of the present invention, including a plurality of cascade GOA unit circuits, disposed at a side of a display area 1 of an LCD panel, for a positive integer n, an output end of n-th stage GOA unit circuit connected to a corresponding n-th gate scan line Gate(n) of the LCD panel; a first test end 3, disposed at a side of the display area 1 of the LCD panel; a second test end 5, disposed at a side of the display area 1 of the LCD panel; a test signal line AT1, disposed at a side of the display area 1 of the LCD panel and electrically connected to the first test end 3; a feedback signal line AT2, disposed at a side of the display area 1 of the LCD panel and electrically connected to the second test end 5; and the same number of test TFTs T0 as the plurality of cascade GOA unit circuits, disposed at a side of the display area 1 of the LCD panel; wherein each test TFT T0 having a gate electrically connected to the test signal line AT1, a source electrically connected to the feedback signal line AT2, and a drain electrically connected to the output end of a corresponding GOA unit circuit and a corresponding gate scan line.

Figure 4:
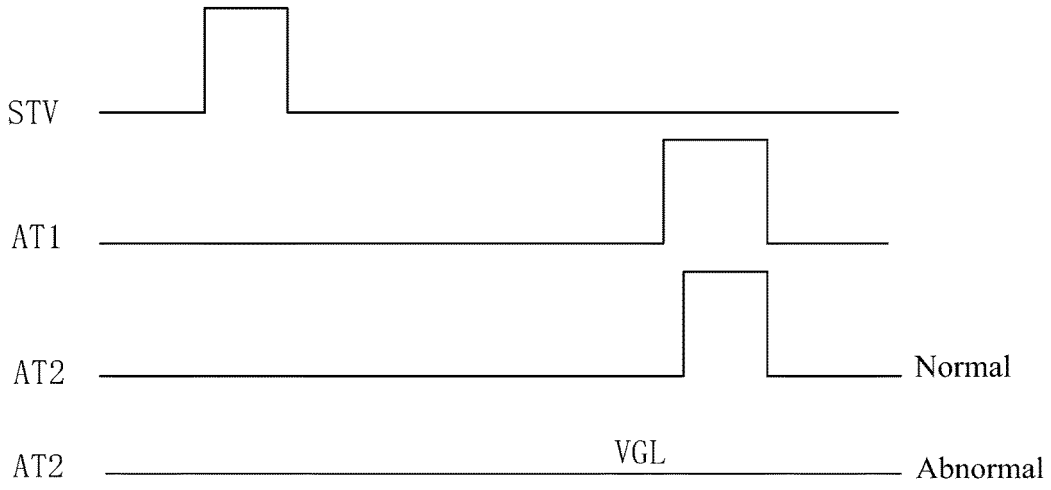
FIG. 4 is a schematic view showing the operation timing of the common circuit for GOA test and eliminating power-off residual images testing the n-th stage GOA unit circuit provided by an embodiment of the present invention.

The first embodiment is able to test the output signal of the GOA unit circuit at any stage in GOA circuits to determine the specific location in a malfunctioning GOA circuit. Specifically, referring to FIG. 2 and FIG. 4, when testing the n-th stage GOA unit circuit, the first test end 3 provides a high-level test pulse signal to the test signal line AT1, the second test end 5 receives an output signal of the n-th stage GOA unit circuit fed back by the test TFT T0 connected to the output end of the corresponding n-th stage GOA unit circuit and the n-th gate scan line transmitted from the feedback signal line AT2 to determine whether the n-th stage GOA unit circuit functions normally.

Moreover, when the common circuit for GOA test and eliminating power-off residual images tests the n-th stage GOA unit circuit: based on the delay of the output signal of the n-th stage GOA unit circuit with respect to the scan starting signal STV, the first test end 3 provides a high-level test pulse signal to the test signal line AT1 to correspondingly make the output end of the n-th stage GOA unit circuit conductive to the test TFT T0 of the n-th gate scan line. The high-level test pulse signal has a high-level duration longer than the high-level duration of an output signal from a normal n-th stage GOA unit circuit, and the high-level test pulse signal rises before the output signal from the normal n-th stage GOA unit circuit rises and falls after the output signal from the normal n-th stage GOA unit circuit falls so as to ensure that during the time that the output signal of the n-th stage GOA unit circuit is at a high level, the connection to the output end of the n-th stage GOA unit circuit and the test TFT T0 n-the n-th gate scan line is always in a conductive state.

When the output signal of the n-th stage GOA unit circuit received by the second test end 5 fed back by the test TFT T0 connected to the output end of the corresponding n-th stage GOA unit circuit and the n-th gate scan line transmitted from the feedback signal line AT2 is a high-level pulse signal, the n-th stage GOA unit circuit is determined to be functioning normally. When the output signal of the n-th stage GOA unit circuit received by the second test end 5 fed back by the test TFT T0 connected to the output end of the corresponding n-th stage GOA unit circuit and the n-th gate scan line transmitted from the feedback signal line AT2 is a low-level constant-voltage signal, the n-th stage GOA unit circuit is determined to be functioning abnormally.

Figure 5:
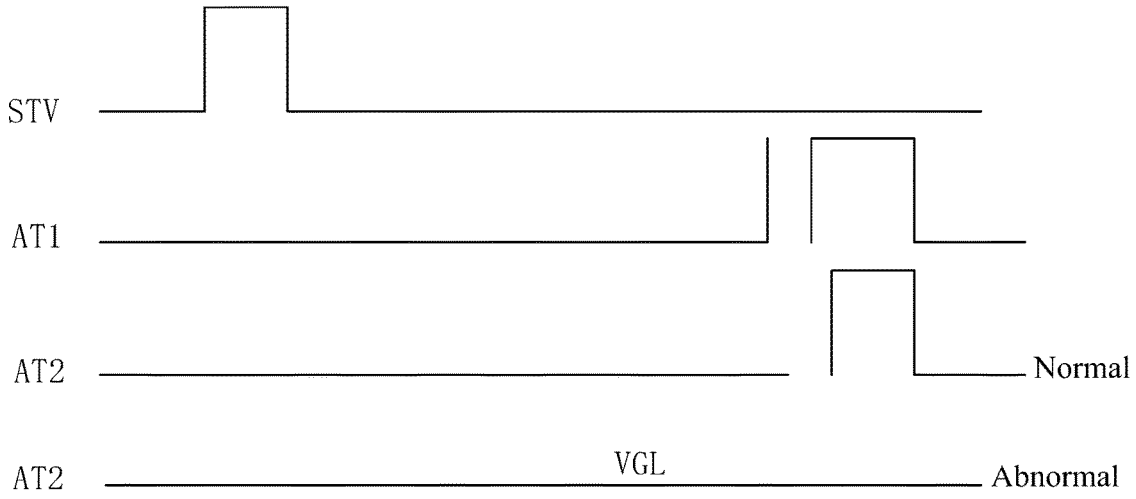
FIG. 5 is a schematic view showing the operation timing of the common circuit for GOA test and eliminating power-off residual images testing the (n+1)-th stage GOA unit circuit provided by an embodiment of the present invention.

Similarly, refer to FIG. 2 and FIG. 5. When testing the (n+1)-th stage GOA unit circuit, based on the delay of the output signal of the (n+1)-th stage GOA unit circuit with respect to the scan starting signal STV, the first test end 3 provides a high-level test pulse signal (delayed for a pulse width compared to the high-level test pulse signal in FIG. 4) to the test signal line AT1 to correspondingly make the output end of the (n+1)-th stage GOA unit circuit conductive to the test TFT T0 of the (n+1)-th gate scan line. The second test end 5 receives an output signal of the (n+1)-th stage GOA unit circuit fed back by the test TFT T0 connected to the output end of the corresponding (n+1)-th stage GOA unit circuit and the (n+1)-th gate scan line transmitted from the feedback signal line AT2 to determine whether the (n+1)-th stage GOA unit circuit functions normally.

Figure 1:
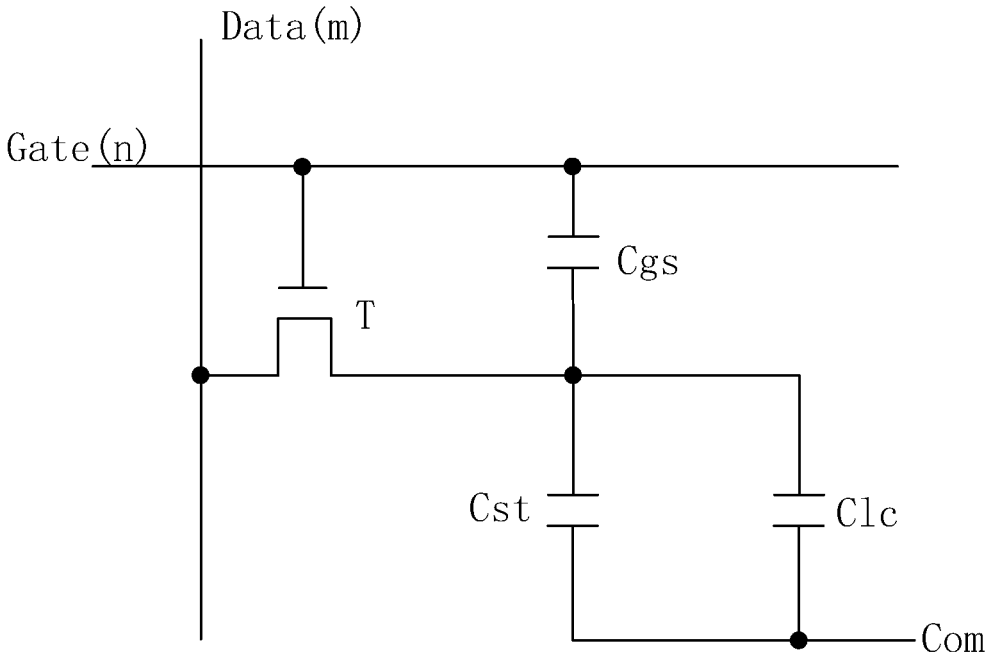
FIG. 1 is a schematic view showing the conventional pixel driving circuit in the display area of an LCD.
Figure 6:
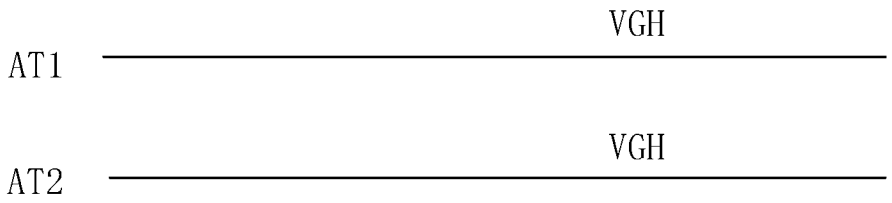
FIG. 6 is a schematic view showing the operation timing of the common circuit for GOA test and eliminating power-off residual images powering off provided by an embodiment of the present invention.

The first embodiment can also release the residual charge of the liquid crystal capacitor and the storage capacitor in the display area of the LCD panel to eliminate the power-off residual images when powering off. Specifically, refer to FIG. 2 and FIG. 6. At the instant of powering off, the first end 3 provides a high-level signal VGH to the test signal line At1, and the second test end 5 provides a high-level signal VGH to the feed signal line AT2 at the same time, all the test TFTs T0 become conductive and the output signals of all the GOA unit circuits rise to the high level. Refer to FIG. 1. All the TFT T of the pixel driving circuits in the display area of the 4 LCD panel are conductive, and the residual charges of the liquid crystal capacitor and the storage capacitor are released. As such, the power-off residual images are eliminated.

The aforementioned first embodiment disposes a plurality of cascade GOA unit circuits, the first test end 3, the second test end 5, the test signal line AT1 the feedback signal line AT2, and a plurality of test TFTs in only one side of the display area 1 of the LCD panel, and thus is suitable for testing single-sided single-driver GOA circuit.

Figure 3:
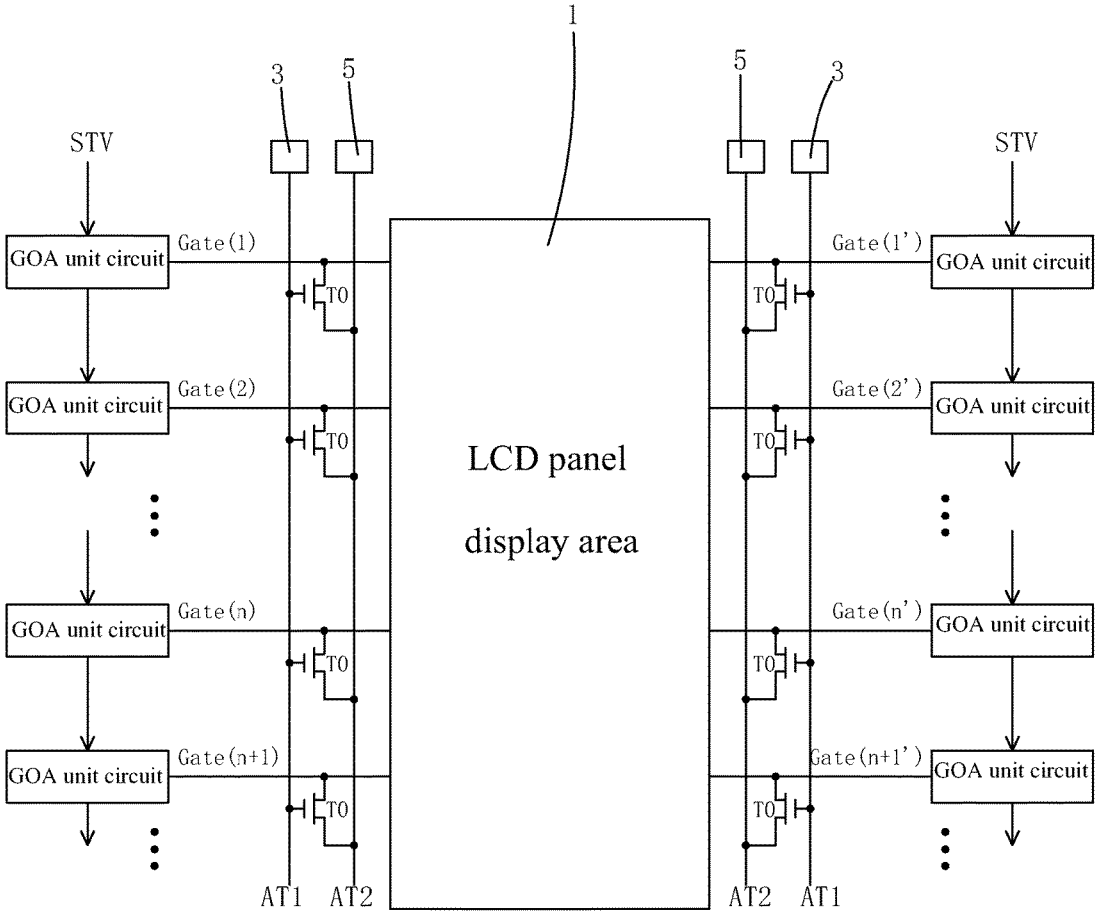
FIG. 3 is a schematic view showing the second embodiment of the common circuit for GOA test and eliminating power-off residual image provided by an embodiment of the present invention.

FIG. 3 is a schematic view showing the second embodiment of the common circuit for GOA test and eliminating power-off residual image provided by an embodiment of the present invention. The second embodiment differ the first embodiment in that the second embodiment further comprises: a plurality of cascade GOA unit circuits, disposed at the other side of the display area 1 of an LCD panel, for a positive integer n' an output end of n'-th stage GOA unit circuit connected to a corresponding n'-th gate scan line Gate(n') of the LCD panel; a first test end 3, disposed at the other side of the display area 1 of the LCD panel; a second test end 5, disposed at the other side of the display area 1 of the LCD panel; a test signal line AT1, disposed at the other side of the display area 1 of the LCD panel and electrically connected to the first test end 3; a feedback signal line AT2, disposed at the other side of the display area 1 of the LCD panel and electrically connected to the second test end 5; and the same number of test TFTs T0 as the plurality of cascade GOA unit circuits, disposed at the other side of the display area 1 of the LCD panel; wherein each test TFT having a gate electrically connected to the test signal line AT1, a source electrically connected to the feedback signal line AT2, and a drain electrically connected to the output end of a corresponding GOA unit circuit and a corresponding gate scan line.

The remaining structure and operation process are the same as the first embodiment, and the detailed description will be omitted.

The second embodiment disposes a plurality of cascade GOA unit circuits, the first test end 3, the second test end 5, the test signal line AT1 the feedback signal line AT2, and a plurality of test TFTs in both sides of the display area 1 of the LCD panel, and thus is suitable for testing double-sided double-driver GOA circuit, and double-sided double-driver GOA circuit.

In summary, the common circuit for GOA test and eliminating power-off residual images of the present invention comprises a first test end, a test signal line electrically connected to the first test end, a second test end, a feedback signal line electrically connected to the second test end, and a plurality of test TFTs having the same number as the number of cascade GOA unit circuits. By connecting the gate of each test TFT to the test signal line, the source to the feedback signal line and the drain to the output end of corresponding GOA unit circuit and corresponding gate scan line, the present invention is able to test the output signal of any stage GOA unit circuit to determine the specific location of a malfunctioning GOA unit circuit, as well as releasing the residual charges of the liquid crystal capacitor and the storage capacitor at the display area of the LCD panel when powering off to eliminate the residual images.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A common circuit for gate driver on array (GOA) test and eliminating power-off residual images, which comprises:

a plurality of cascade GOA unit circuits, disposed at a side of a display area (1) of an LCD panel, for a positive integer n, an output end of n-th stage GOA unit circuit connected to a corresponding n-th gate scan line (Gate (n)) of the LCD panel;

a first test end (3), disposed at a side of the display area (1) of the LCD panel;

a second test end (5), disposed at a side of the display area (1) of the LCD panel;

a test signal line (AT1), disposed at a side of the display area (1) of the LCD panel and electrically connected to the first test end (3);

a feedback signal line (AT2), disposed at a side of the display area (1) of the LCD panel and electrically connected to the second test end (5); and a plurality of test thin film transistors (TFT) (T0), the number of the test TFTs (T0) being the same as the plurality of cascade GOA unit circuits, disposed at a side of the display area (1) of the LCD panel;

wherein each test TFT (T0) having a gate electrically connected to the test signal line (AT1), a source electrically connected to the feedback signal line (AT2), and a drain electrically connected to the output end of a corresponding GOA unit circuit and a corresponding gate scan line.

2. The common circuit for GOA test and eliminating power-off residual images as claimed in claim 1, further comprises:

a plurality of cascade GOA unit circuits, disposed at the other side of the display area (1) of the LCD panel, for a positive integer n', an output end of n'-th stage GOA unit circuit connected to a corresponding n'-th gate scan line of the LCD panel;

a first test end (3), disposed at the other side of the display area (1) of the LCD panel;

a second test end (5), disposed at the other side of the display area (1) of the LCD panel;

a test signal line (AT1), disposed at the other side of the display area (1) of the LCD panel and electrically connected to the first test end (3);

a feedback signal line (AT2), disposed at the other side of the display area (1) of the LCD panel and electrically connected to the second test end (5); and a plurality of test thin film transistors (TFT) (T0), the number of the test TFTs (T0) being the same as the plurality of cascade GOA unit circuits, disposed at the other side of the display area (1) of the LCD panel;

wherein each test TFT having a gate electrically connected to the test signal line AT1, a source electrically connected to the feedback signal line AT2, and a drain electrically connected to the output end of a corresponding GOA unit circuit and a corresponding gate scan line.

3. The common circuit for GOA test and eliminating power-off residual images as claimed in claim 1, wherein when the common circuit for GOA test and eliminating power-off residual images tests the n-th stage GOA unit circuit, the first test end (3) provides a high-level test pulse signal to the test signal line (AT1), the second test end (5) receives an output signal of the n-th stage GOA unit circuit fed back by the test TFT (T0) connected to the output end of the corresponding n-th stage GOA unit circuit and the n-th gate scan line transmitted from the feedback signal line (AT2) to determine whether the n-th stage GOA unit circuit functions normally.

4. The common circuit for GOA test and eliminating power-off residual images as claimed in claim 3, wherein when the common circuit for GOA test and eliminating power-off residual images tests the n-th stage GOA unit circuit, the first test end (3) provides the high-level test pulse signal to the test signal line (AT1) based on the delay of the output signal of the n-th stage GOA unit circuit with respect to the a scan starting signal (STV).

5. The common circuit for GOA test and eliminating power-off residual images as claimed in claim 4, wherein when the common circuit for GOA test and eliminating power-off residual images tests the n-th stage GOA unit circuit, the high-level test pulse signal has a high-level duration longer than the high-level duration of an output signal from a normal n-th stage GOA unit circuit, and the high-level test pulse signal rises before the output signal from the normal n-th stage GOA unit circuit rises and falls after the output signal from the normal n-th stage GOA unit circuit falls.

6. The common circuit for GOA test and eliminating power-off residual images as claimed in claim 3, wherein when the output signal of the n-th stage GOA unit circuit received by the second test end (5) fed back by the test TFT (T0) connected to the output end of the corresponding n-th stage GOA unit circuit and the n-th gate scan line transmitted from the feedback signal line (AT2) is a high-level pulse signal, the n-th stage GOA unit circuit is determined to be functioning normally; when the output signal of the n-th stage GOA unit circuit received by the second test end (5) fed back by the test TFT (T0) connected to the output end of the corresponding n-th stage GOA unit circuit and the n-th gate scan line transmitted from the feedback signal line (AT2) is a low-level constant-voltage signal (VGL), the n-th stage GOA unit circuit is determined to be functioning abnormally.

7. The common circuit for GOA test and eliminating power-off residual images as claimed in claim 1, wherein at a power-off instant, when the first test end (3) provides a high-level signal (VGH) to the test signal line (AT1), and the second test end (5) provides a high-level signal (VGH) to the feed signal line (AT2), all the test TFTs (T0) become conductive and the output signals of all the GOA unit circuits rise to the high level.

8. The common circuit for GOA test and eliminating power-off residual images as claimed in claim 1, wherein the common circuit for GOA test and eliminating power-off residual images is applied to testing single-sided single-driver GOA circuits.

9. The common circuit for GOA test and eliminating power-off residual images as claimed in claim 2, wherein the common circuit for GOA test and eliminating power-off residual images is applied to testing double-sided double-driver GOA circuits, and double-sided single-driver GOA circuits.

* * * * *